US007131919B2

(12) United States Patent
Kohler et al.

(10) Patent No.: US 7,131,919 B2
(45) Date of Patent: Nov. 7, 2006

(54) LACROSSE HEAD HAVING AN ARTICULATED MEMBER

(75) Inventors: Dale W. Kohler, Sparks, MD (US); Kenneth E. Sherman, Hampstead, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 11/065,036

(22) Filed: Feb. 25, 2005

(65) Prior Publication Data

US 2005/0197216 A1 Sep. 8, 2005

Related U.S. Application Data

(62) Division of application No. 10/630,856, filed on Jul. 31, 2003, now Pat. No. 6,916,259.

(60) Provisional application No. 60/399,722, filed on Aug. 1, 2002.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/505; D21/724

See application file for complete search history.

(56) References Cited

U.S. PATENT DOCUMENTS

| | | | | |
|---|---|---|---|---|
| 3,507,495 A | | 4/1970 | Tucker et al. | |
| 3,702,702 A | * | 11/1972 | Hoult | 473/513 |
| 3,822,062 A | | 7/1974 | Tucker et al. | |
| 4,034,984 A | | 7/1977 | Crawford et al. | |
| 4,097,046 A | | 6/1978 | Friant | |
| 4,128,239 A | | 12/1978 | Grenadier et al. | |
| 4,206,918 A | | 6/1980 | Lewis, Jr. | |
| 5,048,843 A | | 9/1991 | Dorfi et al. | |
| 5,082,290 A | | 1/1992 | Tucker et al. | |
| 5,174,580 A | | 12/1992 | Pratt | |
| 5,269,532 A | | 12/1993 | Tucker et al. | |
| 5,566,947 A | * | 10/1996 | Tucker et al. | 473/513 |
| 5,935,026 A | | 8/1999 | Dill et al. | |
| 6,066,056 A | | 5/2000 | Morrow et al. | |

FOREIGN PATENT DOCUMENTS

| | | |
|---|---|---|
| CA | 342045 | * 10/1932 |
| GB | 424742 | 2/1935 |
| GB | 1589596 | 7/1977 |

OTHER PUBLICATIONS

PCT International Search Report PCT/US02/20088.
Great Atlantic Lacrosse Company Catalog, Oct. 2001.

* cited by examiner

*Primary Examiner*—Eugene Kim
*Assistant Examiner*—M. Chambers
(74) *Attorney, Agent, or Firm*—Pillsbury Winthrop Shaw Pittman LLP

(57) ABSTRACT

A lacrosse head having a frame and an articulated member moveably coupled to the frame. In one embodiment, a lacrosse head includes a stop member; a first sidewall connected to the stop member; a second sidewall connected to the stop member opposite the first sidewall; and a scoop connected to the first sidewall and the second sidewall opposite the stop member, wherein the first sidewall includes a first member integrally connected to the stop member and the scoop, and a second member moveably coupled to the first member. The second member can include pocket thread openings for attaching a pocket to the head. The lacrosse head can also include a stiffening member attached to the scoop and a sidewall of the frame, and a collared male plug for joining the frame to a hollow shaft.

22 Claims, 19 Drawing Sheets

LACROSSE HEAD HAVING AN ARTICULATED MEMBER

This application is a division of U.S. application Ser. No. 10/630,856, filed Jul. 31, 2003 now U.S. Pat. No. 6,916,259, which claims the benefit of U.S. Provisional Application No. 60/399,722, filed Aug. 1, 2002, which are both herein incorporated by referenced in their entirety.

BACKGROUND

1. Field of the Invention

The present invention relates generally to lacrosse sticks, and more particularly, to a lacrosse head having an articulated member from which to suspend a pocket. The lacrosse head can further include a stiffening member attached to the scoop and a sidewall, and a connector for joining the head to a hollow lacrosse stick shaft.

2. Background of the Invention

FIG. 1 illustrates a conventional lacrosse stick 100 having a handle 102 shown in dotted lines and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string holes 124 and a string laced through string holes 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Of particular relevance to the present invention are rules relating to the height of the sidewalls of the head. In a lacrosse game, these dimensional requirements prevent a player from using a stick that unfairly protects the lacrosse ball within a deeper pocket, such that it is more difficult for opponents to check the ball free. For this reason, men's rules permit a pocket depth of up to 2½ inches, below a sidewall that is up to 2 inches high. According to the traditional test, when looking horizontally at the sidewall of the men's lacrosse stick with a regulation ball inside the pocket, the sidewall must obstruct the view of at least a portion of the ball. The total height of the sidewall and pocket must not exceed 4½ inches. Similarly, women's rules limit the height of the sidewall to 1.8 inches (1⅘ inches or 4.5 cm) at the point of its greatest height, such that the top of a regulation ball placed inside the pocket can be always be seen over the sidewall when looking horizontally at the sidewall.

Several drawbacks are associated with conventional lacrosse head designs, relating to stiff pockets that hinder ball control, areas in the head that are susceptible to deformation, wide distances between sidewalls that make it difficult to keep a ball in the pocket, and means of attaching the head to a shaft that prevent a player from positioning his hand on the shaft close to the head. These drawbacks are discussed below.

In an effort to deepen a pocket as much as possible, some conventional men's lacrosse heads maximize the height of the sidewalls to the upper limit of 2 inches that is mandated by applicable rules. Coupled with the maximum allowed 2½-inch pocket, this sidewall height provides the lacrosse head with the maximum allowed total depth of 4½ inches. Unfortunately, maximizing the height of the traditional monolithic rigid sidewall offers no flexibility to the pocket. The rigid frame of the lacrosse head can make the overall pocket stiff and unforgiving. Indeed, the only flexible component of the conventional men's lacrosse head is the 2½ inches of pocket. A sharp jolt to the stick, as often happens when a player is checked, can cause the stiff pocket to propel the ball out of the lacrosse head. In addition, the rigid frame limits the degree to which the pocket swings during cradling, and therefore the degree to which a ball in the pocket can move under the frame into a position from which it is more difficult to dislodge. Players would therefore prefer a more flexible pocket that better dampens ball movement and widens the arc of the pocket swing to keep a ball in the lacrosse head.

Considering another drawback, on traditional lacrosse heads, at the transition area between the sidewalls and the scoop, the frame decreases in thickness to eliminate unnecessary weight and to provide the contour necessary to form the pocket. In addition to decreasing in thickness, at this transition area, the sidewalls turn and open up to provide the flat surface area of the scoop. This transition area therefore becomes a weak portion of the frame, and is vulnerable to bending, twisting, and breaking. The top of the frame can bend easily at this transition area, in both side-to-side and front-to-back directions. The deformation of the lacrosse head frame is especially noticeable during the rigorous contact encountered while facing off, checking, and scooping up ground balls. To improve ball control, players would therefore prefer a stiffer lacrosse head frame that better resists these frontal and lateral impacts.

As another factor in ball control, players tend to prefer narrower pockets that better restrain a ball within the pocket. Lacrosse stick designers cannot, however, simply shorten the distance between the sidewalls because of commonly accepted rules mandating the overall width of the head. For example, Section 18 of Rule 1-17 of the 2001 NCAA Men's Lacrosse Rules states that "[t]he head of the crosse at its widest point shall measure between 6½ and 10 inches, inside measurement." Thus, the sidewalls must be at least 6½ inches apart at their widest point.

To circumvent this rule, some lacrosse head designers have added interior structures to the sidewalls of the lacrosse head frame. One known example is the "Rock" lacrosse head manufactured by Shamrock of Summit, N.J. The "Rock" includes wings that are integral to the sidewalls of the lacrosse head, and are intended to channel a ball to release from the center of the pocket. Another example is the ball retaining ridges described in U.S. Pat. No. 6,066,056 to Morrow. The structures in these examples do not, however, improve the rigidity of the lacrosse head in the transition area between the scoop and sidewalls.

Turning to another drawback of conventional lacrosse heads, as shown in FIG. 1, the traditional means for attaching head 104 to handle or shaft 102 involves sliding shaft 102 into juncture 106 of head 104 and securing head 104 to shaft 102 with a screw or similar fastener placed in opening 107. In effect, juncture 106 serves as a female connection that receives shaft 102. Unfortunately, this configuration requires the distance between stop member 114 and juncture 106 to be relatively long to provide adequate stability between head 104 and shaft 102. Because commonly accepted rules prohibit a player from placing a hand on head 104 while carrying a ball, the long distance between stop member 114 and juncture 106 necessitates a player's holding shaft 102 a significant distance away from the pocket, and therefore from the ball inside the pocket, and from the center of gravity created by the combined mass of the ball and lacrosse head. Players therefore have a diminished feel for the ball in the pocket.

To shorten the distance between stop member 114 and juncture 106, a male plug that fits within the bore of shaft 102 could be used, as suggested in U.S. Pat. No. 5,935,026 to Dill et al. This male plug connection, however, provides a relatively weak attachment because the shaft is held onto the male plug by only the friction fit between the components. A stronger connection that still permits the shorter distance between stop member 114 and juncture 106 would be desirable.

SUMMARY OF THE INVENTION

In addressing one or more of the above-mentioned needs, the present invention provides a lacrosse head having at least one of the following features: 1) an articulated member moveably coupled to a rigid lacrosse head frame, which provides flexibility to the frame and/or pocket of the lacrosse head; 2) one or more stiffening members that provide rigidity between a sidewall and the scoop; and 3) a collared male plug connector for joining the head to a hollow lacrosse stick shaft.

A first embodiment of the present invention provides a lacrosse head having a rigid frame and an articulated member moveably coupled to the rigid frame. The articulated member can be a moveable part of any portion of the frame, such as the sidewalls, the scoop, or the stop. The moveably coupled, articulated member can also be part of any side of the frame, such as the top of a sidewall (corresponding to the front face of the lacrosse head) or the bottom of the scoop (corresponding to the back of the lacrosse head). The articulated member can also be moveably coupled to swing as an extension of the lacrosse head frame (e.g., as a flap on the edge of the frame) or as a moveable interior portion of the frame (e.g., as a moveable cutout within the rigid frame). Finally, the articulated member can include stringing holes to which the pocket threading attaches to provide additional flexibility to the pocket.

In an exemplary implementation, the articulated member is an articulated sidewall member moveably coupled to a rigid sidewall member of the lacrosse head. The rigid sidewall member is integral with the overall rigid frame of the lacrosse head. By virtue of the moveable coupling (e.g., a hinge), the articulated sidewall member moves (e.g., swings) independently from the rigid sidewall member. The articulated sidewall member includes thread openings to which the pocket of the lacrosse head is strung. In this manner, the movement of the articulated sidewall member increases the overall flexibility of the pocket. This improved flexibility provides a pocket suspension that more effectively dampens the movement of a ball inside the pocket and widens the arc of the pocket swing during cradling.

While gaining flexibility along the height of the sidewall, the articulated sidewall still enables a player to achieve the maximum total allowable depth of a pocket (e.g., 4½ inches for men's lacrosse heads). As part of the sidewall, the articulated sidewall member would be included in measuring the height of the sidewall. Thus, the articulated sidewall member and the rigid sidewall member would be measured together, preferably at the maximum height of 2 inches, so that the overall pocket depth is maximized at 4½ inches when a 2½ inch deep pocket is attached.

A second embodiment of the present invention provides a lacrosse head having at least one stringable stiffening member attached to the scoop and a sidewall of the head. Preferably, two stringable stiffening members are symmetrically disposed, each connected to an opposite sidewall and the scoop. Each stringable stiffening member bridges two points on the lacrosse head, one point on the sidewall and one point on the scoop. Each stringable stiffening member is attached at its one end to the sidewall and at its opposite end to the scoop.

In a specific implementation, the stringable stiffening member is a gusset that is roughly triangular in shape, with one side of the triangular shape continuously attached to the lacrosse head from a point on the scoop to a point on a sidewall. The gusset includes an opening through which a pocket thread can be strung.

The stringable stiffening member of the present invention offers several benefits. First, the stringable stiffening member strengthens the vulnerable transition area of the lacrosse head between the sidewalls and the scoop. The additional rigidity helps resist deformation of the head.

As a second benefit, the stringable stiffening member narrows the pocket at the widest section of the frame to help a player maintain better control over a ball in the pocket. In providing this beneficial narrowing with the stringable stiffening member, the present invention still permits a lacrosse head to comply with applicable rules governing the minimum width of the lacrosse head because the sidewalls can be set at the minimum width, with a shorter width between two opposing stringable stiffening members.

As a third benefit, the stringable stiffening member provides an additional stringing option for attaching a pocket to the lacrosse head. With a single-member stiffening member, the gap between the stiffening member and the lacrosse head frame can serve as a thread opening. With the gusset, an opening (e.g., holes or a slot) provided in the gusset can serve as a thread opening.

A third embodiment of the present invention provides a lacrosse head having a collared male plug for connecting the head to a hollow shaft. The lacrosse head includes a male plug adapted to fit within the hollow bore of a shaft. The male plug includes compressible members (e.g., ribs) that provide a snug friction fit with shafts having a range of different bore dimensions. In addition, this embodiment includes a snubbed collar around the male plug that creates a gap between the collar and the male plug. This gap receives the wall of the shaft. To further secure the shaft, a fastener is preferably placed through an opening in the collar. Optionally, the shaft and possibly also the male plug have openings to receive the fastener, which are aligned with the opening in the collar.

In this configuration, the shaft is held securely in place by the friction fit of the male plug, the friction fit of the collar, and the fastener. The collared male plug therefore provides a significantly stronger connection in comparison to the simple male plug connections suggested by the prior art. In addition, the snubbed collar allows a player to place his hand closer to the center of gravity of the lacrosse head and ball, providing a better feel for stick handling and ball control.

The compressible members on the male plug also provide a significant benefit. Many players purchase lacrosse stick shafts and heads independently and assemble custom sticks. For example, a player may prefer the head of one manufacturer and the shaft of another manufacturer, for cost or performance reasons. Players also frequently break lacrosse stick shafts and must replace them with different models or makes. To promote as many sales as possible, manufacturers tend to use uniform dimensions of the outside diameters of shafts and the corresponding female connections on the lacrosse heads. However, the inside dimensions of shafts can vary widely, due to different wall thicknesses, geometries, and shaft materials. For example, a titanium shaft would have a thinner wall than an aluminum shaft. The compressible members on the male plug help accommodate these varying inside shaft dimensions.

DETAILED DESCRIPTION OF THE INVENTION

Figure 1:
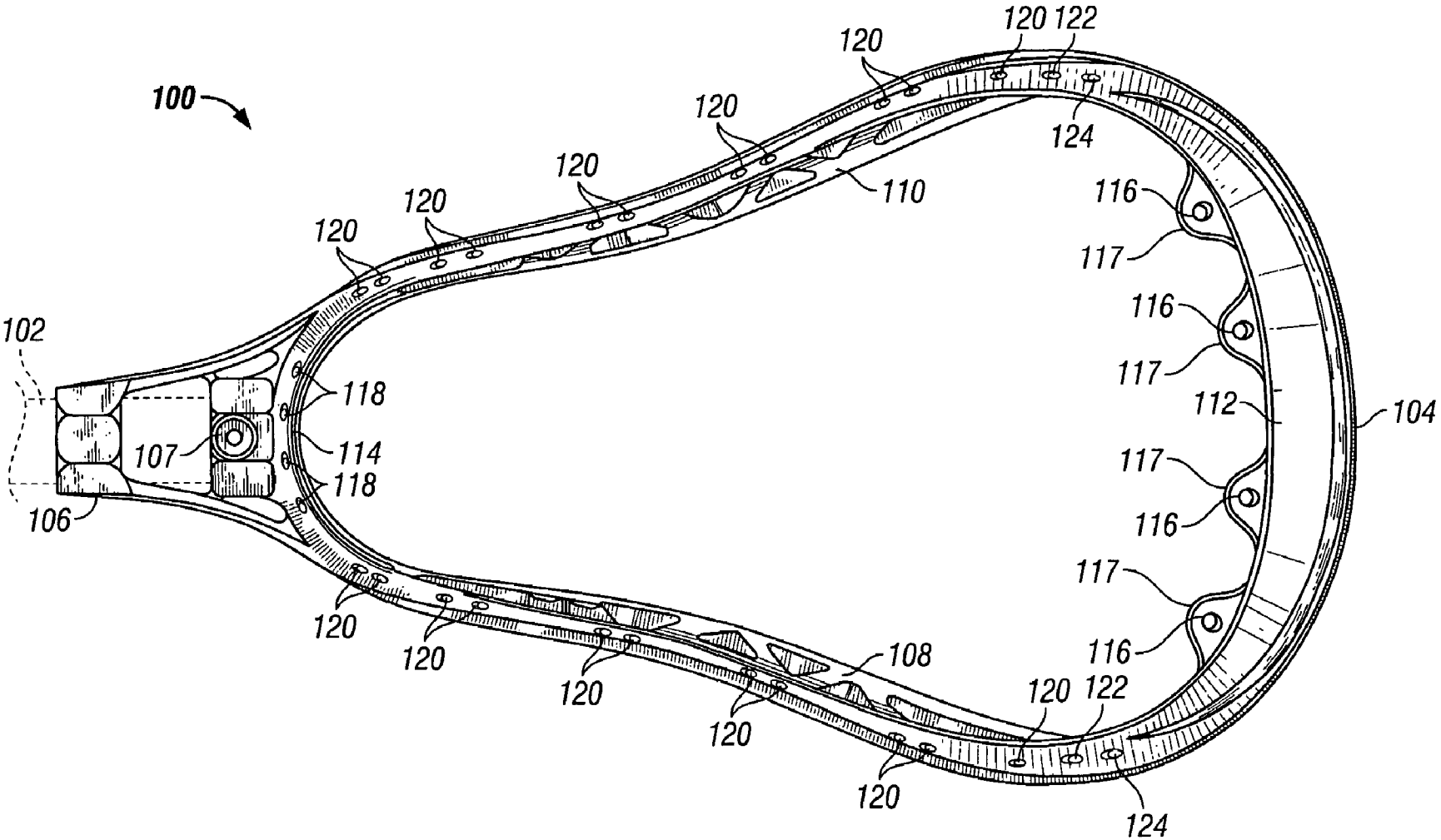
FIG. 1 (Prior Art)
FIG. 1 is a schematic diagram of a lacrosse stick.
Figure 2:
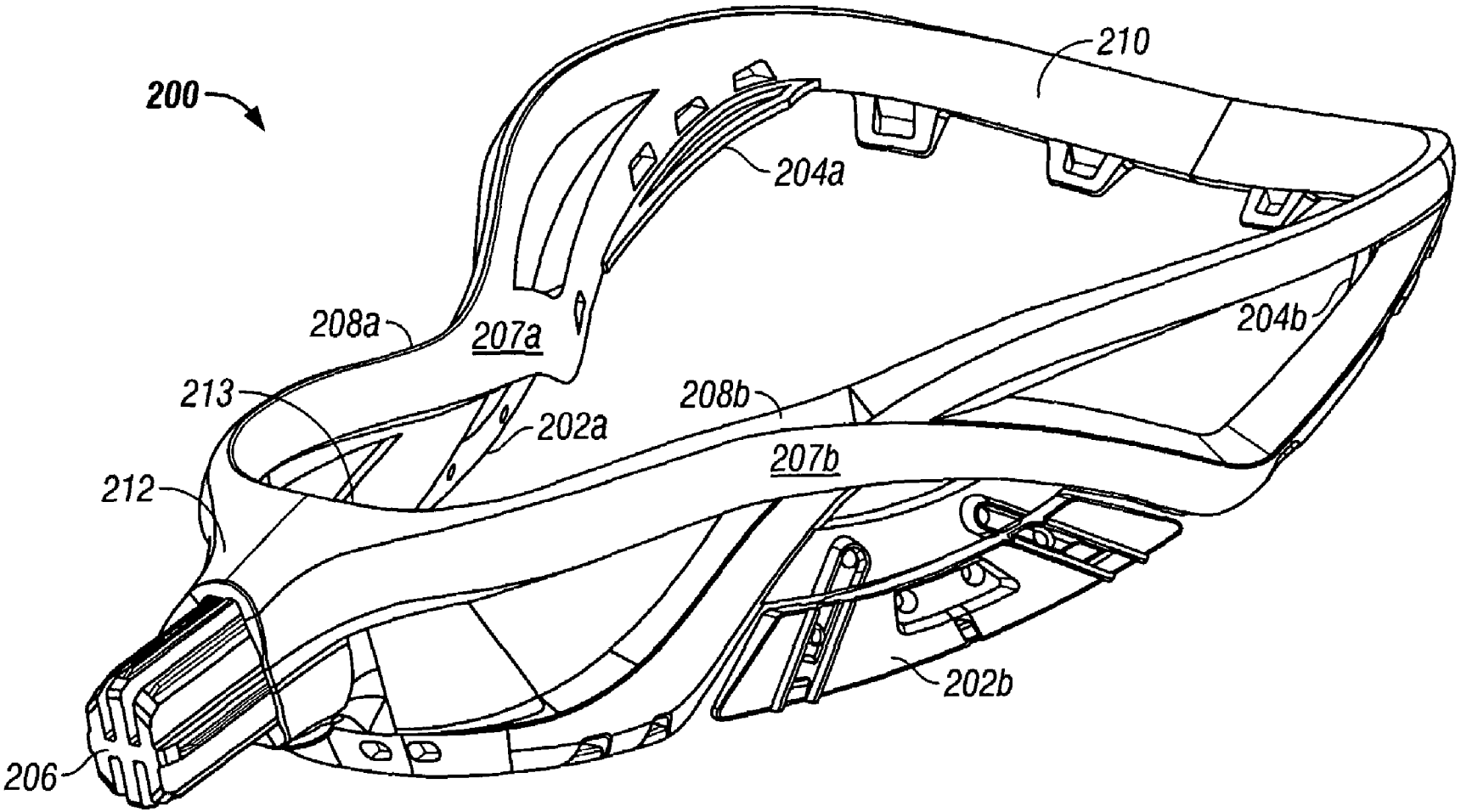
FIG. 2 is a schematic diagram of an isometric view of an exemplary lacrosse head having articulated sidewall members, stiffening members, and a collared male plug, according to an embodiment of the present invention.
Figure 3:
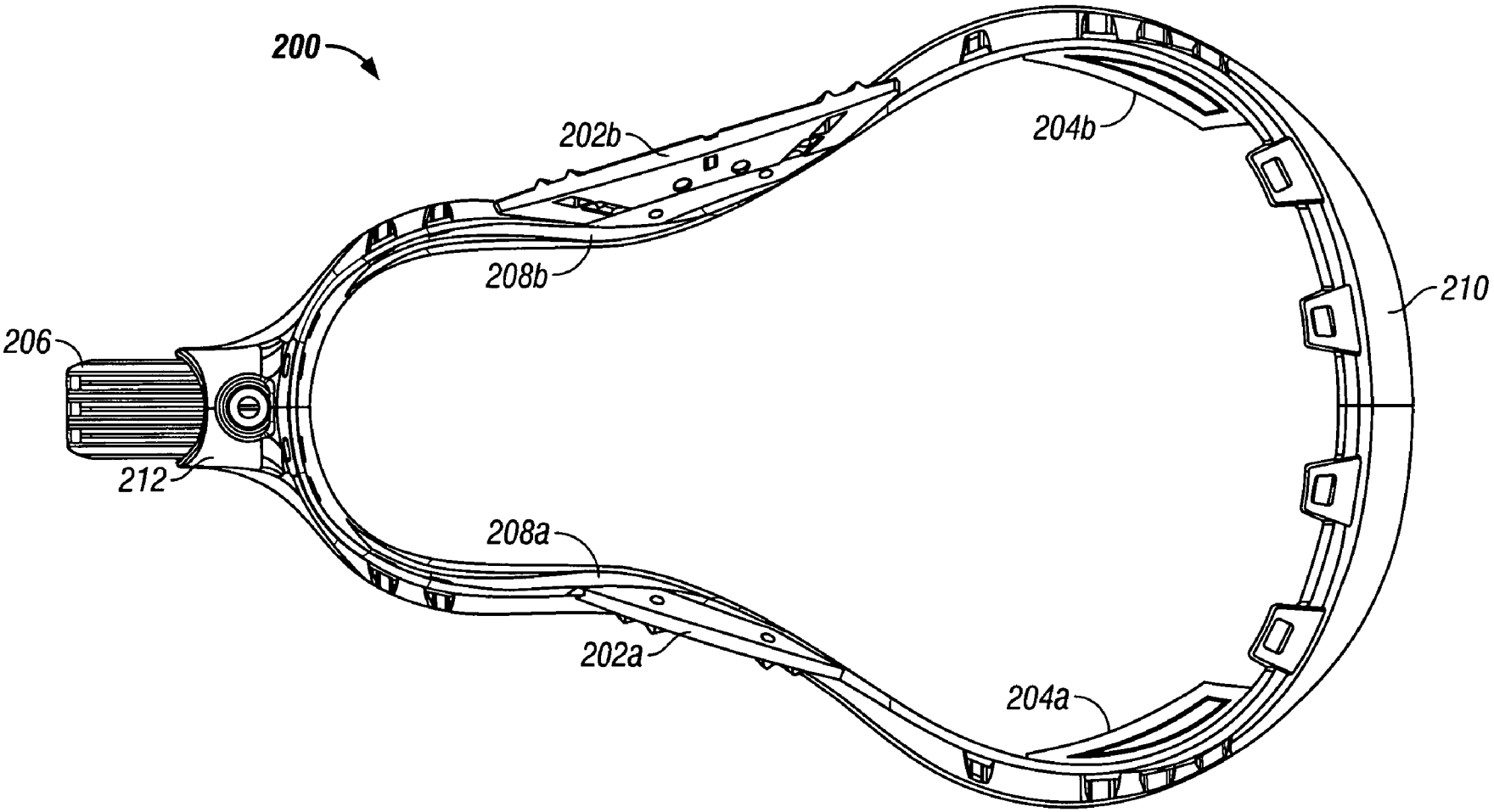
FIG. 3 is a schematic diagram of a bottom view of the lacrosse head of FIG. 2.
Figure 4:
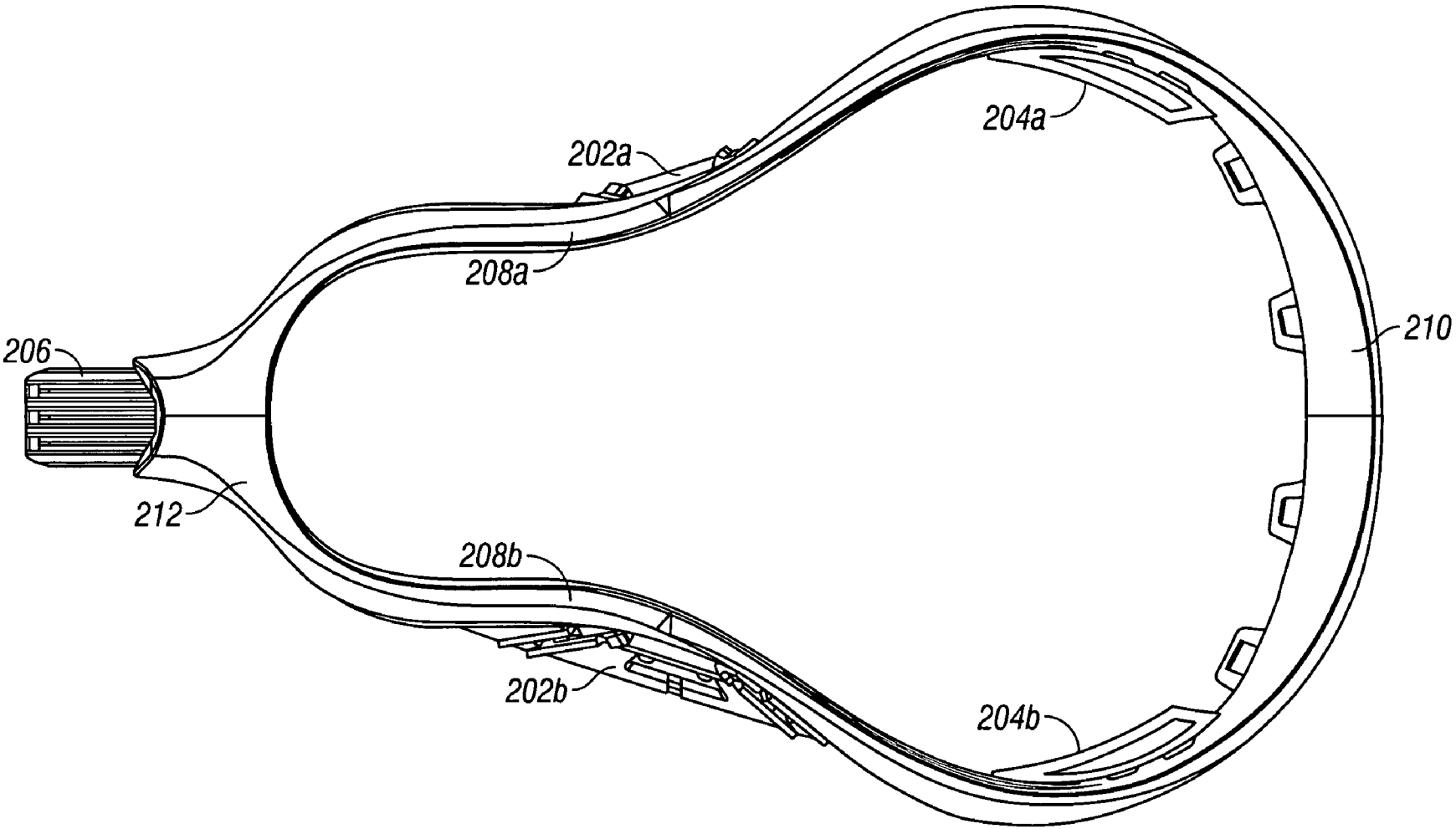
FIG. 4 is a schematic diagram of a top view of the lacrosse head of FIG. 2.

FIGS. 2–4 illustrate a first exemplary lacrosse head 200, according to an embodiment of the present invention. As shown, lacrosse head 200 includes a scoop 210, sidewalls 208*a* and 208*b* connected to scoop 210, and a throat area 212 connected to sidewalls 208*a* and 208*b*. Sidewall 208*a* includes an articulated sidewall member 202*a* moveably coupled to a sidewall member 207*a*. Likewise, sidewall 208*b* includes an articulated sidewall member 202*b* moveably coupled a sidewall member 207*b*. A stiffening member 204*a* is attached to lacrosse head 200 from a point on sidewall 208*a* to a point on the scoop 210 of lacrosse head 200. Similarly, a stiffening member 204*b* is attached to lacrosse head 200 from a point on sidewall 208*b* to a point on scoop 210. Collared male plug 206 is disposed on the throat area 212 of lacrosse head 200.

Figure 5A:
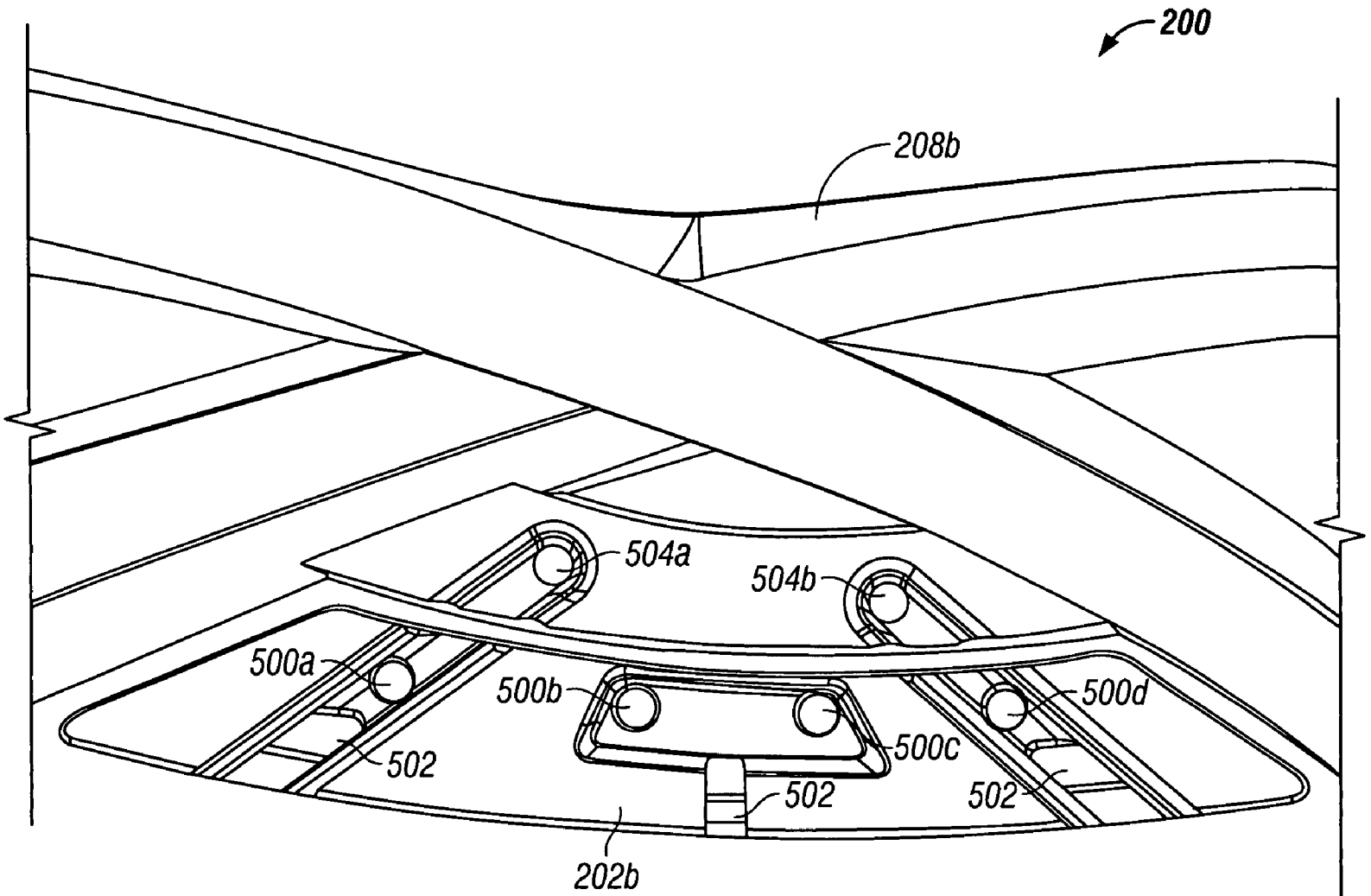
FIG. 5A is a schematic diagram of an enlarged view of a sidewall and articulated sidewall member of the lacrosse head of FIG. 2.
Figure 5B:
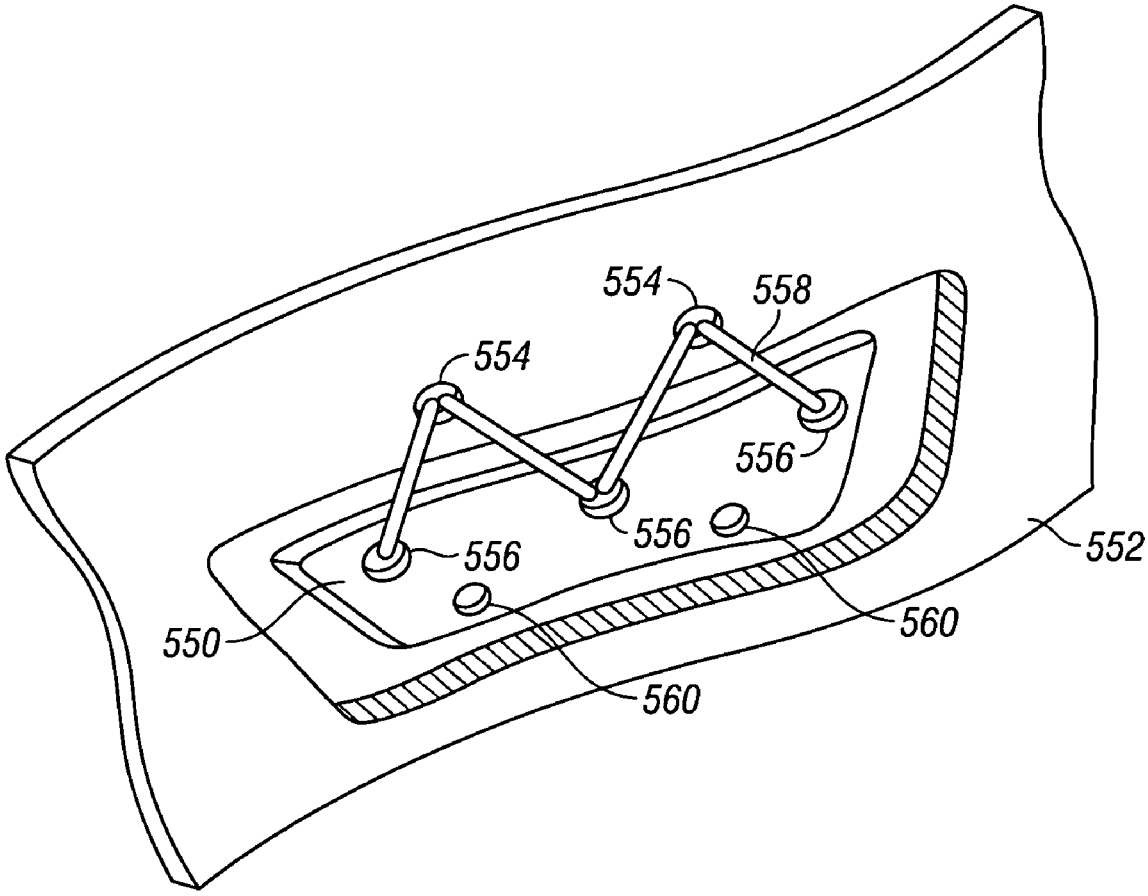
FIG. 5B is a schematic diagram of an articulated sidewall member formed as an interior portion (e.g., cutout) of lacrosse head frame, according to an alternative embodiment of the present invention.

FIG. 5A shows an enlarged view of articulated sidewall member 202*b*, including its three thread holes 502 and four coupling holes 500*a*–500*d*. The thread holes 502 receive threads of the pocket of head 200. The four coupling holes 500*a*, 500*b*, 500*c*, and 500*d* cooperate with coupling holes 504*a* and 504*b* on sidewall member 207*b* of lacrosse head 200 to receive a cord (not shown) that flexibly attaches articulated sidewall member 202*b* to the rigid sidewall member 207*b*. As an example, a cord could be routed from a knot tied at coupling hole 500*a* to coupling hole 504*a*, then to coupling hole 500*b*, then to coupling hole 500*c*, then to coupling hole 504*b*, and finally to coupling hole 500*d*, where a second knot is tied. The cord is preferably made of nylon. Alternatively, the cord is made of a more elastic material, such as rubber or a multi-strand elastic (e.g., as in a bungee cord). Attached by a cord, articulated sidewall member 202*b* can freely swing from the rigid sidewall member 207*b* and provide further flexibility to the overall pocket.

While gaining flexibility along the height of sidewall 208*b*, articulated sidewall member 202*b* can still achieve the maximum total allowable depth of a pocket (e.g., 4½ inches for men's lacrosse heads). As part of sidewall 208*b*, articulated sidewall member 202*b* would be included in measuring the height of sidewall 208*b*. Thus, articulated sidewall member 202*b* and sidewall member 207*b* would be measured together, preferably at the maximum height of 2 inches, so that the overall pocket depth is maximized at 4½ inches when a 2½ inch deep pocket is attached. As shown in FIG. 2, sidewall member 207*b* has a first height proximate to where it joins the stop member 213 in throat area 212 and a second height proximate to where articulated sidewall member 202*b* is moveably coupled. The first height is greater than the second height, such that the sum of the first height and the height of articulated sidewall member 202*b* is no greater than the first height. In this manner, the articulated sidewall member 202*b* and the sidewall member 207*b* can together provide the maximum allowable height of sidewall 208*b*.

For illustration purposes, FIGS. 2–5A show articulated members that can be attached to the sidewall of a lacrosse head using cord, to provide additional pocket flexibility. However, as one of ordinary skill in the art would appreciate, any number of flexible attachment means could be used to couple an articulated member to a lacrosse head. For example, a mechanical hinge, similar to those used on doors, could flexibly attach an articulated member to a lacrosse head. As another example, an elastomeric strap molded onto both the articulated member and the lacrosse head could attach the articulated member to the head, while still enabling independent movement of the articulated member. For that reason, and notwithstanding the particular benefits associated with using a cord to attach an articulated member to a lacrosse head, the present invention should be considered to broadly include any means for moveably coupling an articulated member to a lacrosse head.

In addition, FIGS. 2–5A illustrate articulated members moveably coupled to swing as an extension of the lacrosse head frame (e.g., as a flap on the edge of the frame). Alternatively, as shown in FIG. 5B, an articulated member could be a moveable interior portion 550 of a lacrosse head frame 552 (e.g., as a moveable cutout within the rigid frame). For example, a sidewall could be made of a rigid first portion that is attached to the stop member and scoop, and a second portion that is interior to and moveably coupled to the rigid first portion. In this example, frame 552 and articulated member 550 include coupling holes 554 and 556, respectively. A cord 558 strung through coupling holes 554 and 556 moveably couples articulated member 550 to frame 552. Articulated member 550 includes thread openings 560 for attaching a pocket.

Figure 6:
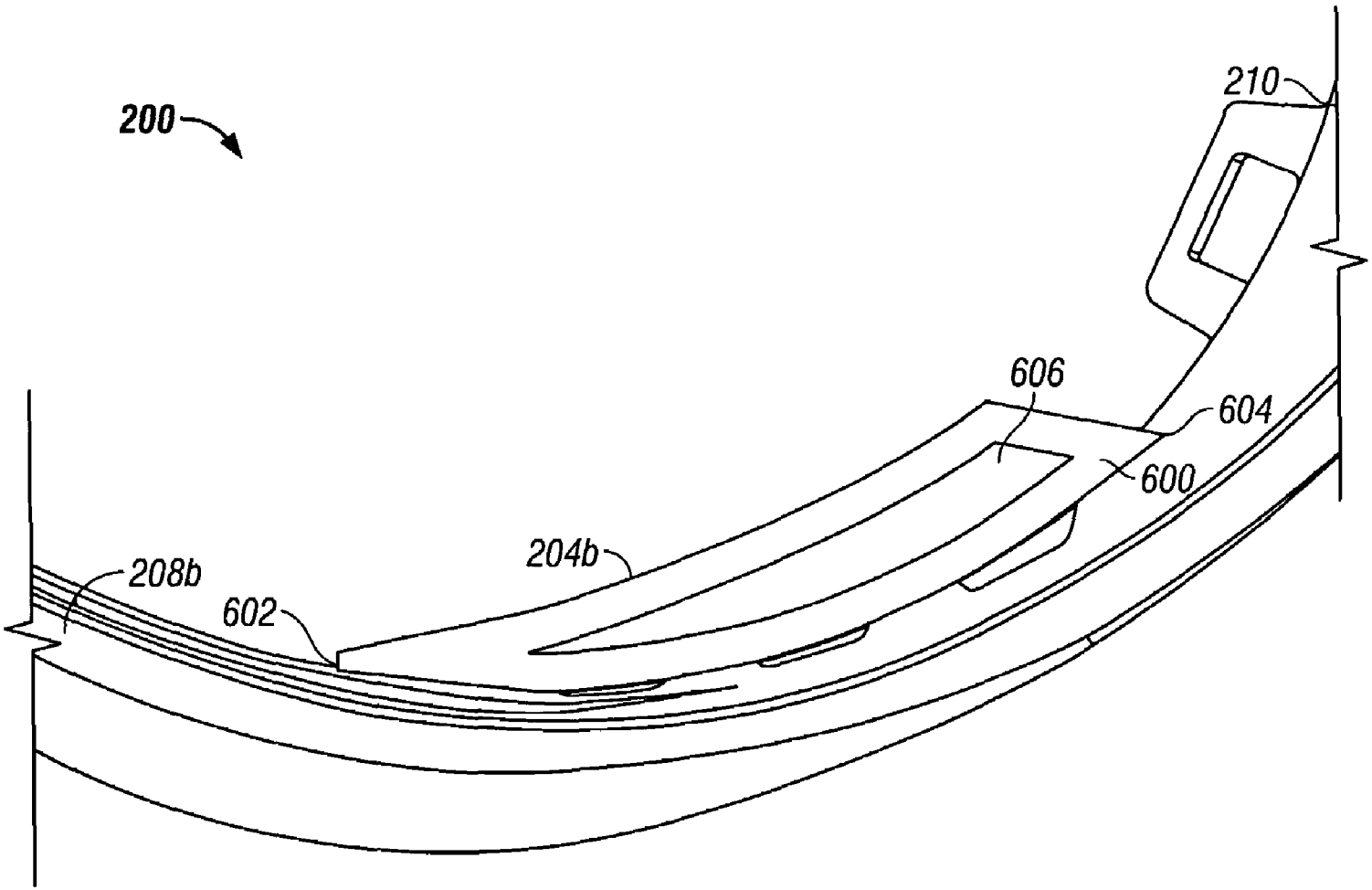
FIG. 6 is a schematic diagram of an enlarged view of a stiffening member of the lacrosse head of FIG. 2.

FIG. 6 shows an enlarged view of the stiffening member 204*b* of FIG. 2. In this example, stiffening member 204*b* is a triangular gusset having one side 600 continuously attached to lacrosse head 200 from a point 602 on sidewall 208*b* to a point 604 on scoop 210. Stiffening member 204*b* also includes an opening 606, which provides an additional pocket stringing option and minimizes the weight of stiffening member 204*b*.

Although FIG. 6 shows stiffening member 204*b* as a triangular gusset, one of ordinary skill in the art would appreciate that any number of shapes could provide the desired stiffening characteristics. Indeed, a stiffening member could simply be a single straight member with its first end attached to a sidewall and its second end attached to the scoop. In spanning the distance between these points, the single straight member would create a gap between the member and the lacrosse head through which pocket stringing could be routed and secured.

Figure 7:
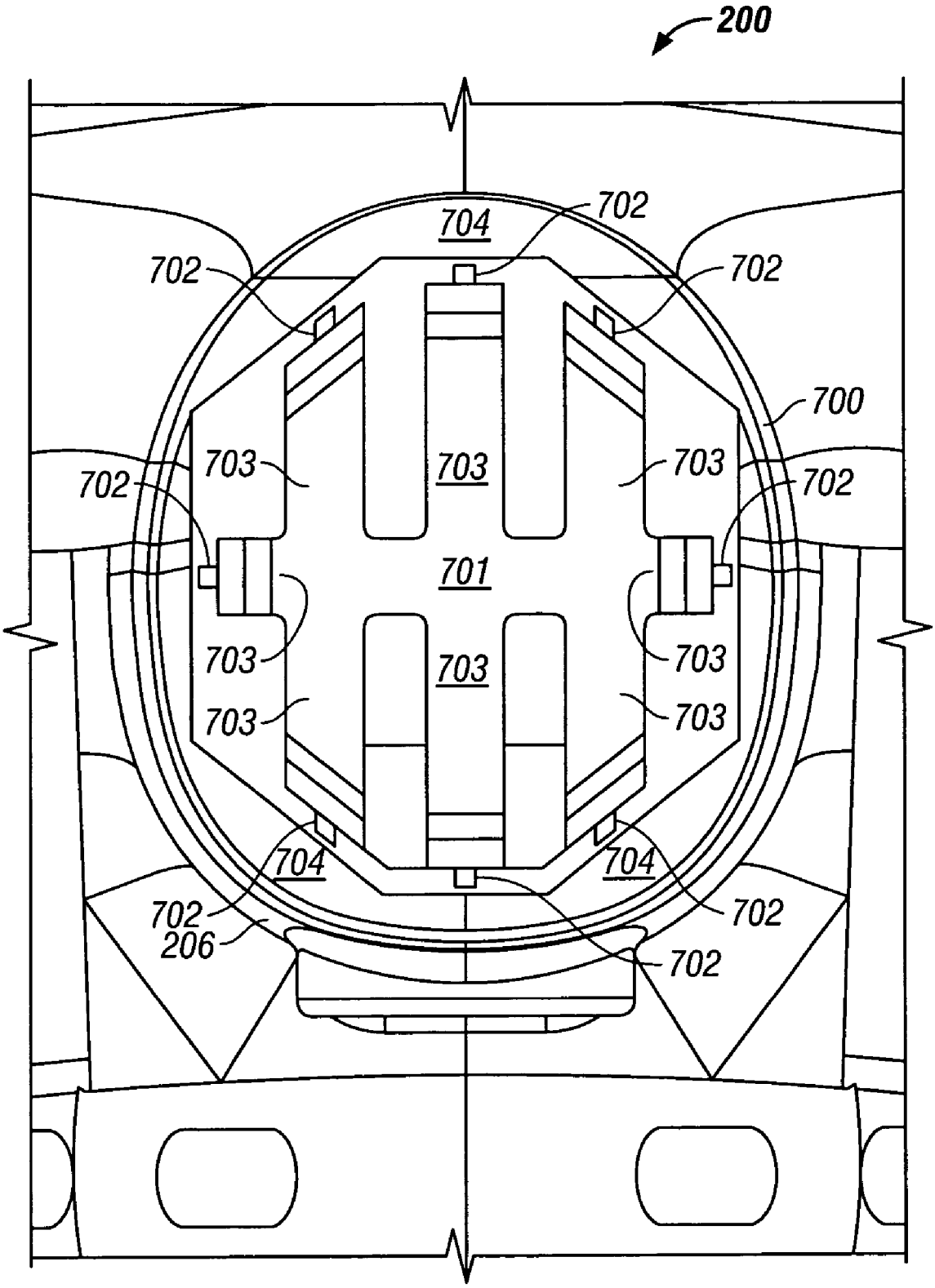
FIG. 7 is a schematic diagram of an enlarged axial view of the collared male plug of the lacrosse head of FIG. 2.
Figure 8:
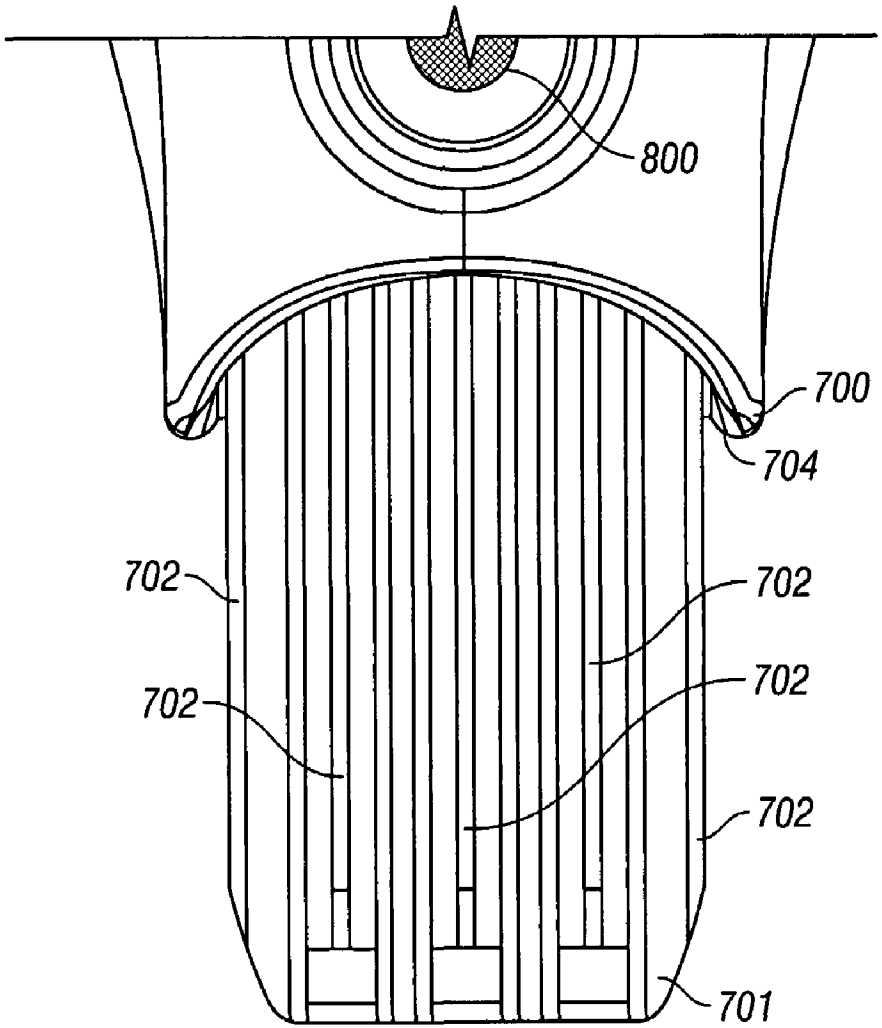
FIG. 8 is a schematic diagram of an enlarged bottom view of the collared male plug of the lacrosse head of FIG. 2.
Figure 9:
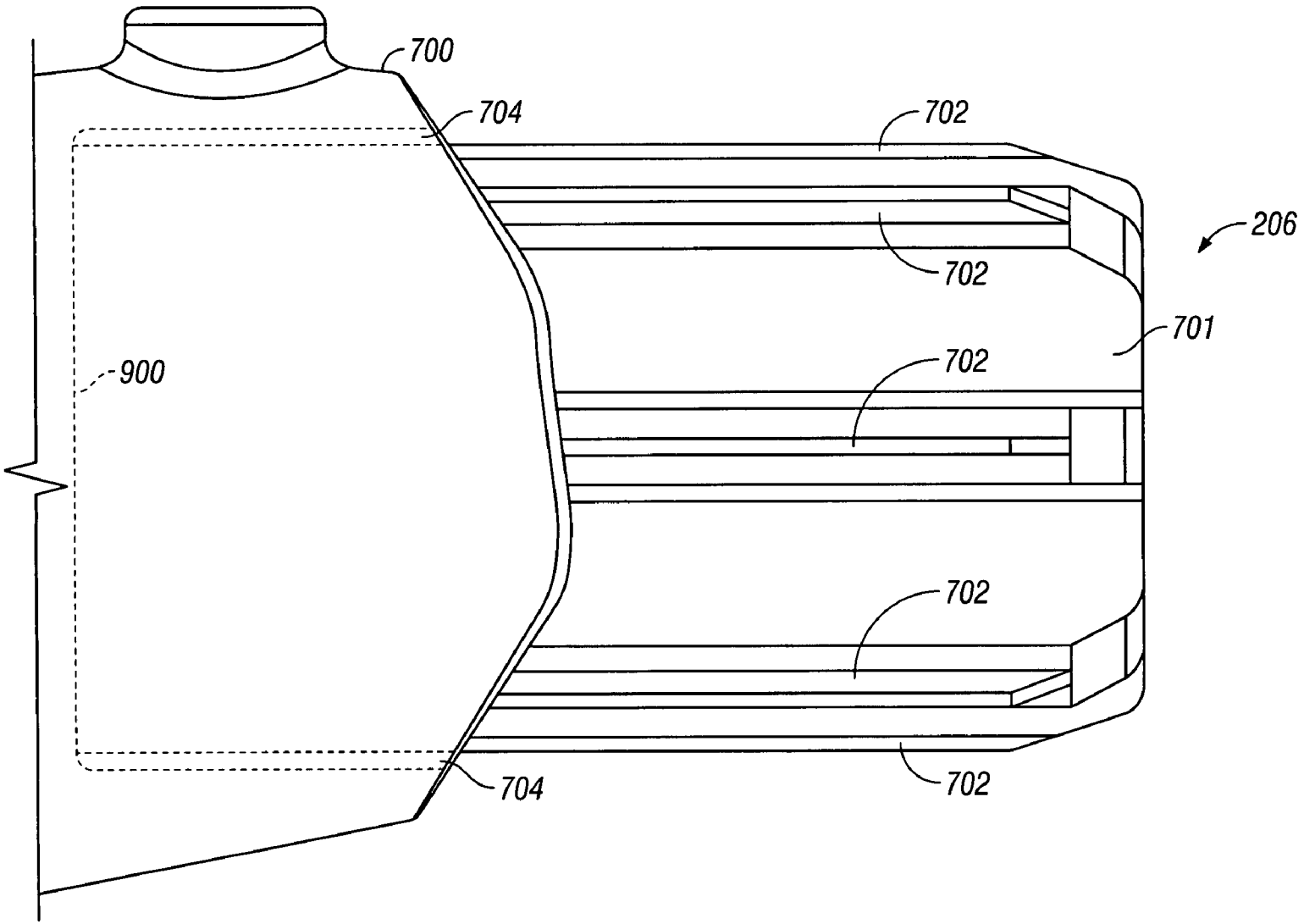
FIG. 9 is a schematic diagram of an enlarged side view of the collared male plug of the lacrosse head of FIG. 2.

FIGS. 7–9 show enlarged views of the exemplary collared male plug 206 of FIG. 2. As shown, collared male plug 206 includes a core 701 having eight compressible members 702 that are adapted to fit within the hollow bore of a lacrosse stick shaft. Compressible members 702 compress within the shaft to provide a snug friction fit. This compression enables collared male plug 206 to accommodate a range of bore dimensions. In this exemplary configuration, the end of core 701 is rounded to facilitate placement inside the bore of a shaft. Core 701 also includes radial members 703 on which compressible members 702 are disposed.

Located around a portion of the length of core 701 and compressible members 702 is a collar 700. The dotted lines in FIG. 9 show the portion of core 701 and compressible members 702 that is enclosed by collar 700. Collar 700 creates a gap 704 into which the wall of the shaft slides. As shown in FIG. 8, aligned openings 800 are located in collar 700 and core 701. These aligned openings 800 line up with a hole in the shaft, when the shaft is inserted into gap 704 such that it abuts the inside end 900 (see FIG. 9) of collar 700. A fastener, such as a screw, is placed in aligned openings 800 and through the hole of the shaft to secure the shaft to lacrosse head 200.

Although FIG. 7 illustrates a collared male plug 206 suitable for roughly octagonal-shaped shafts, it should be understood that a collared male plug according to the present invention could be adapted to fit any variety of shaft shapes, such as tear-drop, asymmetrical, and oval. Indeed, the collared male plug of the present invention could be adapted to accommodate a cylindrical shaft or a shaft having any number of sides.

FIGS. 10A–16 illustrate a second exemplary lacrosse head 1000, according to another embodiment of the present invention. In comparison to lacrosse head 200 of FIG. 2, lacrosse head 1000 demonstrates different implementations of an articulated sidewall member and a collared male plug.

As shown in FIGS. 10A–10D, lacrosse head 1000 includes articulated sidewall members 1002*a* and 1002*b*, stiffening members 1004*a* and 1004*b*, and a collared male plug 1006. Articulated sidewall member 1002*a* is a part of sidewall 1008*a* of lacrosse head 1000. Likewise, articulated sidewall member 1002*b* is a part of sidewall 1008*b* of head 1000. Stiffening member 1004*a* is attached to lacrosse head 1000 from a point on sidewall 1008*a* to a point on the scoop 1010 of lacrosse head 1000. Similarly, stiffening member 1004*b* is attached to lacrosse head 1000 from a point on sidewall 1008*b* to a point on scoop 1010. Collared male plug 1006 is disposed on the throat area 1012 of lacrosse head 1000.

Figure 10C:
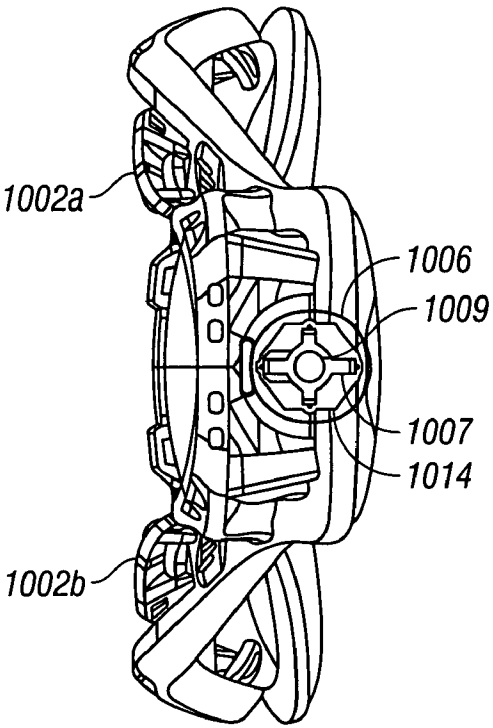
FIG. 10C is a schematic diagram of a side view of the lacrosse stick of FIG. 10A, along the axis of the shaft of the lacrosse stick.
Figure 10B:
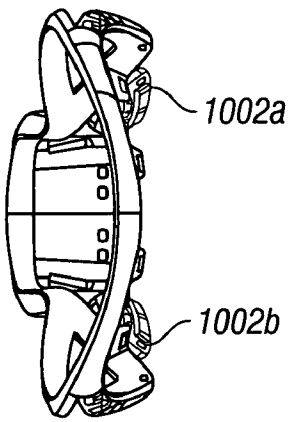
FIG. 10B is a schematic diagram of a side view of the lacrosse stick of FIG. 10A, facing the scoop of the head.
Figure 10A:
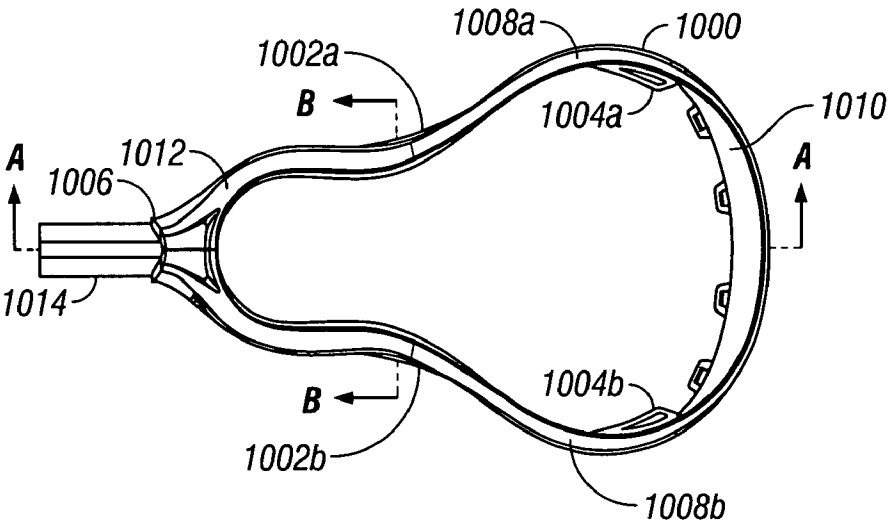
FIG. 10A is a schematic diagram of a top view of an exemplary lacrosse stick having articulated sidewall members, stiffening members, and a collared male plug, according to another embodiment of the present invention.
Figure 12:
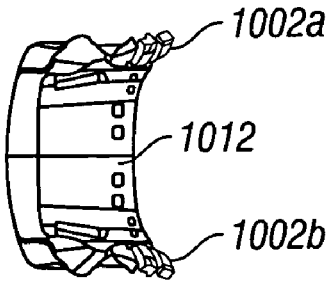
FIG. 12 is a schematic diagram of a cross-section of the lacrosse stick of FIG. 10A along line B—B.
Figure 13A:
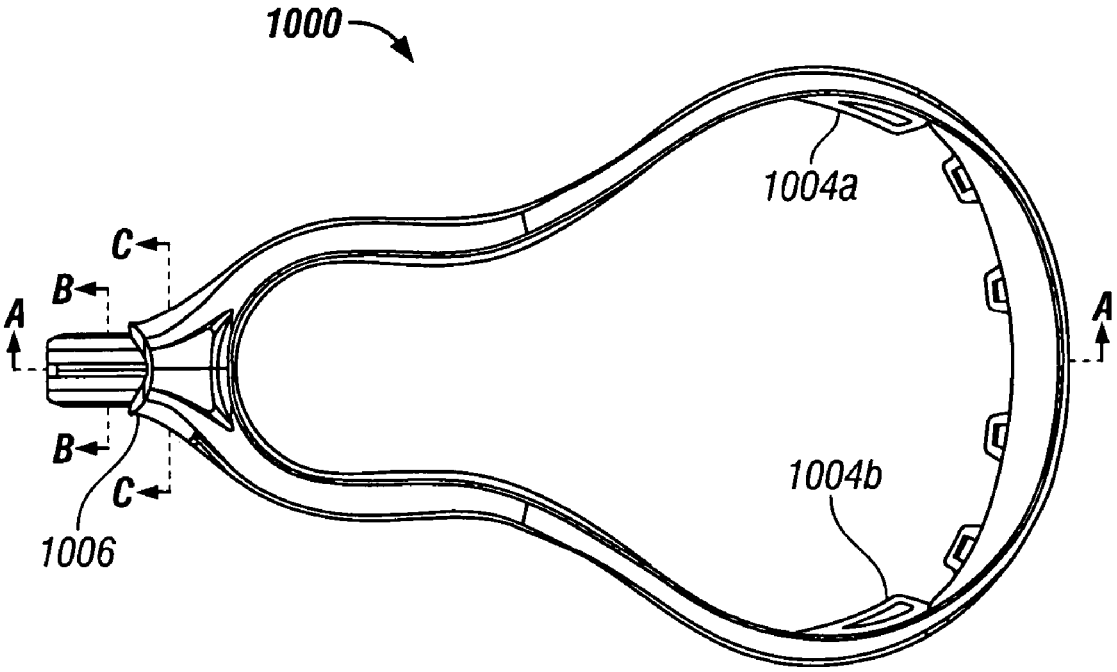
FIG. 13A is a schematic diagram of a top view of the lacrosse head of FIG. 10A.
Figure 13B:
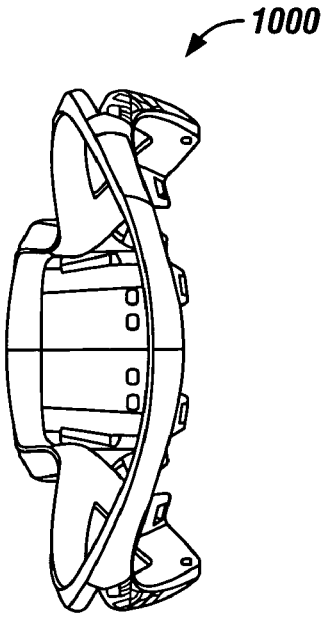
FIG. 13B is a schematic diagram of a side view of the lacrosse head of FIG. 13A, facing the scoop of the lacrosse head.
Figure 13C:
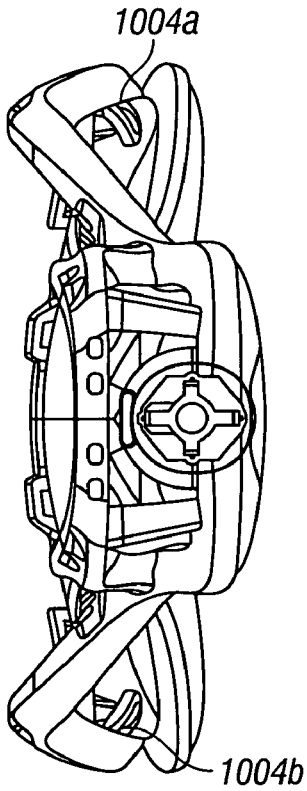
FIG. 13C is a schematic diagram of a side view of the lacrosse head of FIG. 13A, facing the collared male plug of the lacrosse head.
Figure 13D:
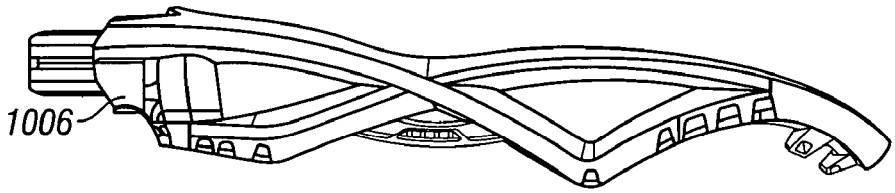
FIG. 13D is a schematic diagram of a side view of the lacrosse head of FIG. 13A, facing the outside face of a sidewall of the lacrosse head.
Figure 13E:
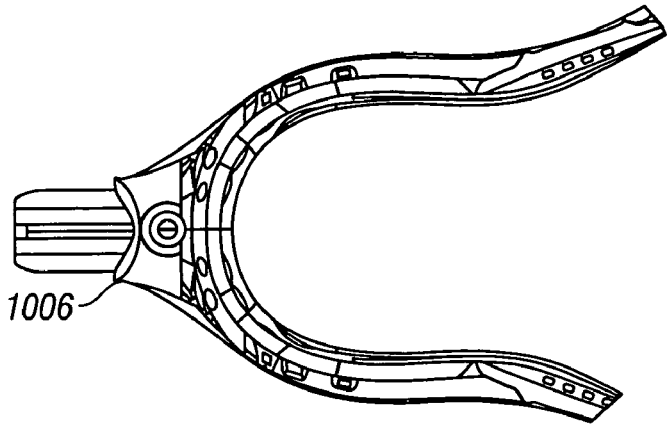
FIG. 13E is a schematic diagram of a partial bottom view of the lacrosse head of FIG. 13A.

FIG. 12 illustrates a cross-section of the lacrosse head 1000 of FIG. 10A along line B—B. This cross-sectional view faces the throat area 1012 of lacrosse head 1000 and cuts through articulated sidewall members 1002*a* and 1002*b*.

Figure 11:
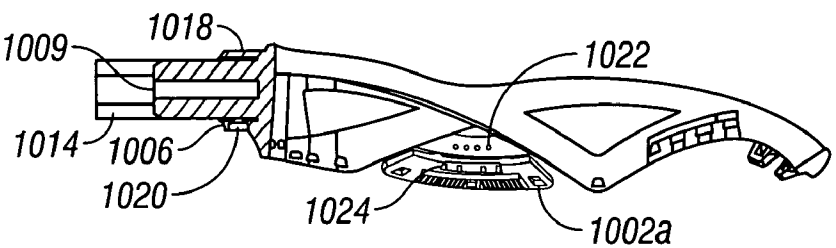
FIG. 11 is a schematic diagram of a cross-section of the lacrosse stick of FIG. 10A along line A—A.
Figure 10D:
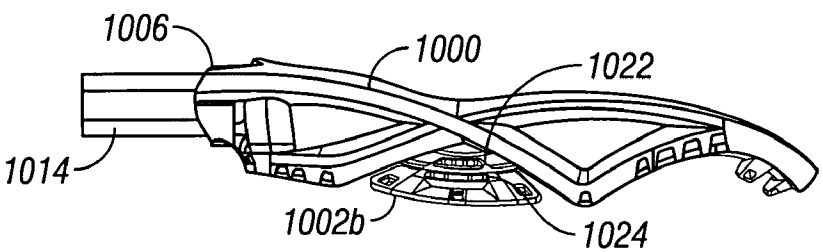
FIG. 10D is a schematic diagram of a side view of the lacrosse stick of FIG. 10A, facing the outside face of a sidewall of the head.

FIGS. 10A, 10D, and 11 also show a shaft 1014 attached to lacrosse head 1000. As shown best in the cross-sectional view of FIG. 11, the hollow bore of shaft 1014 fits around the core 1009 of collared male plug 1006. In addition, the wall of shaft 1014 fits within the collar 1018 of collared male plug 1006. Collared male plug 1006 therefore provides a friction fit between shaft 1014 and core 1009, and between shaft 1014 and collar 1018. In addition, a fastener is placed in openings 1020 of collared male plug 1006 and shaft 1014, to secure shaft 1014 to lacrosse head 1000. Optionally, core 1009 could have an opening aligned with openings 1020 to receive the fastener.

Figure 23:
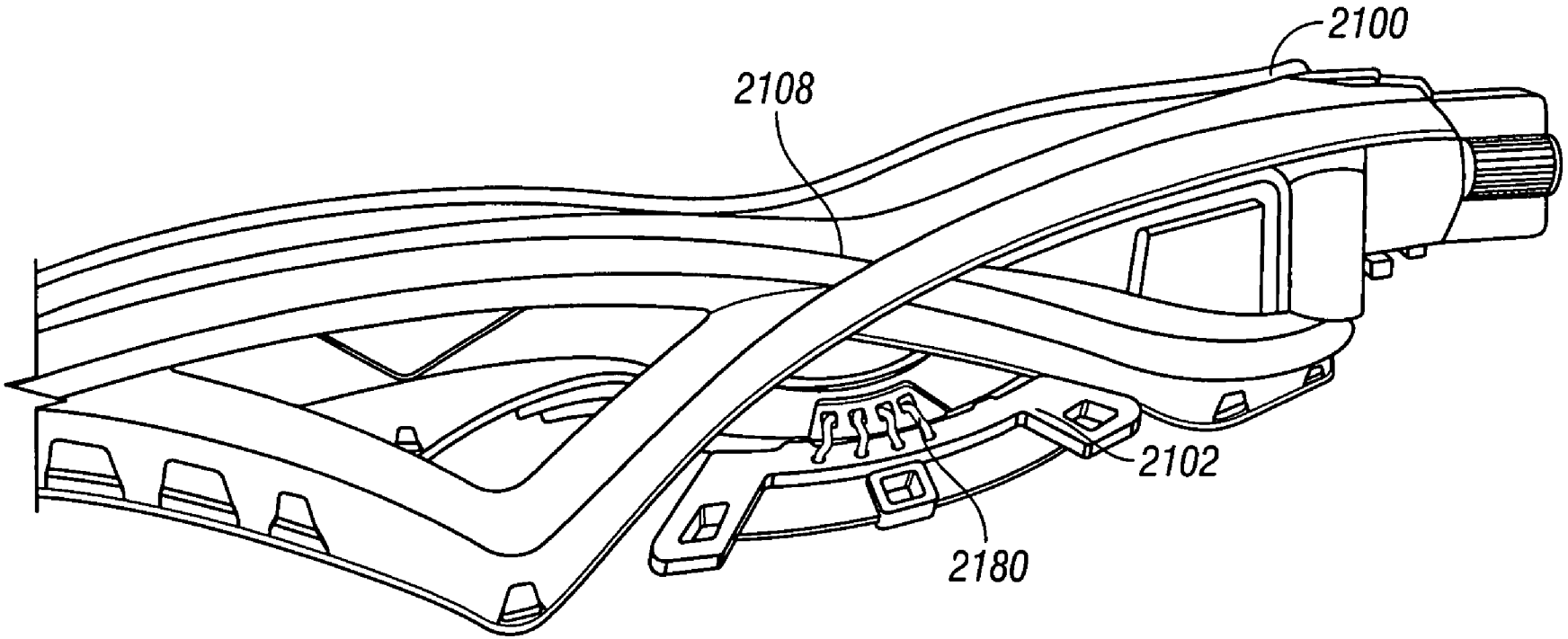
FIG. 23 is an image of an exemplary lacrosse head, showing an articulated sidewall member attached to a sidewall of the head with cord, and showing a collared male plug, according to an embodiment of the present invention.

As shown in FIGS. 10D and 11, articulated sidewall members 1002*a* and 1002*b* are connected to lacrosse head 1000 with a cord (not shown) strung through four coupling holes 1022 in sidewalls 1008 and four corresponding coupling holes 1024 in articulated sidewall members 1002. The cord provides a flexible hinge movement for articulated sidewall members 1002. An example of a suitable cord is a 1/32-inch nylon cord with a core. FIG. 23 shows an example of a cord 2180 attaching an articulated sidewall member 2102 to a sidewall member 2108 of a lacrosse head 2100.

Figure 17:
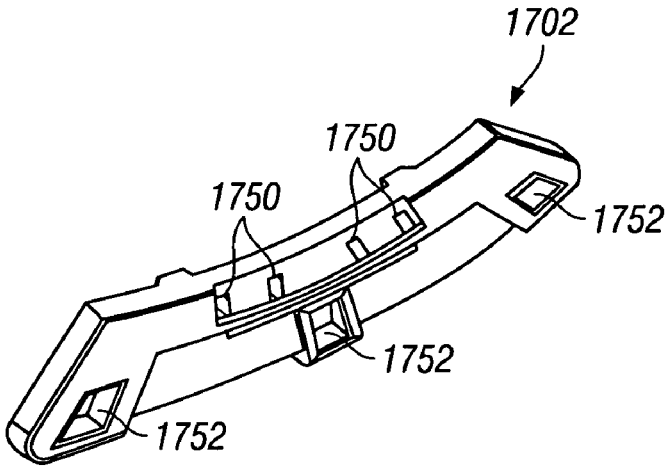
FIGS. 17 and 18 are schematic diagrams of enlarged views of an exemplary articulated sidewall member, according to an embodiment of the present invention.
Figure 18:
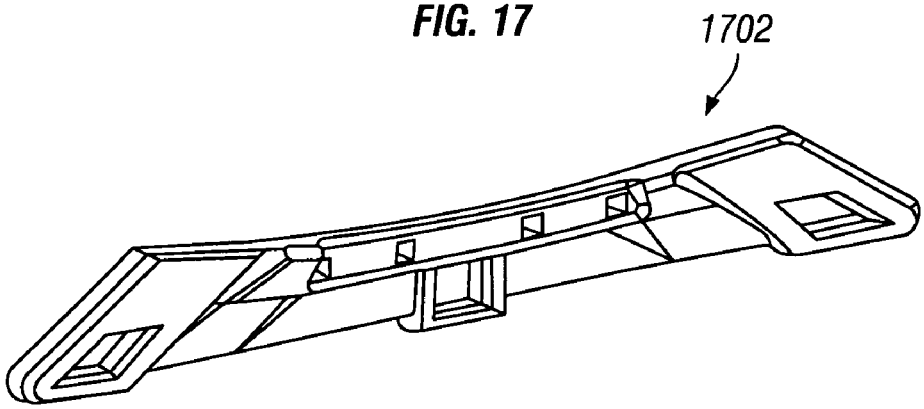
Figure 19:
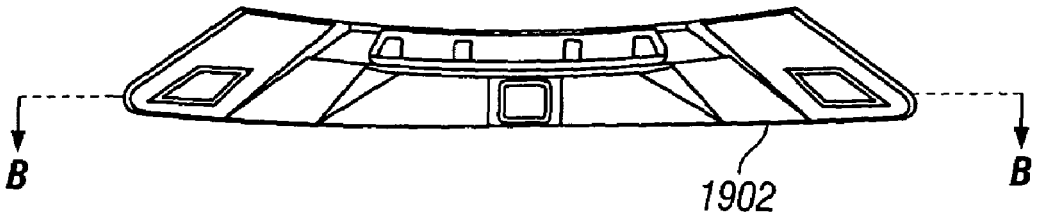
FIG. 19 is a schematic diagram of an enlarged view of an exemplary articulated sidewall member having overlays, according to an embodiment of the present invention.
Figure 20:
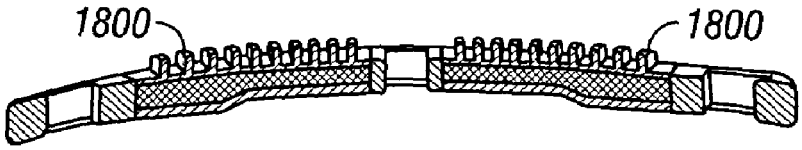
FIG. 20 is a schematic diagram of cross-sectional view of the articulated sidewall member of FIG. 19, along line B—B.
Figure 21:
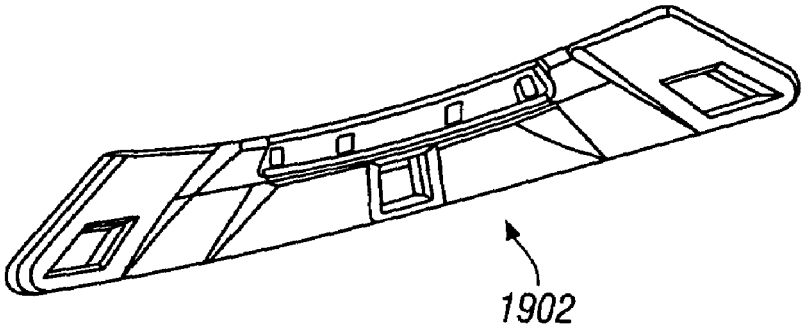
FIG. 21 is a schematic diagram of an isometric view of the articulated sidewall member of FIG. 19.
Figure 22:
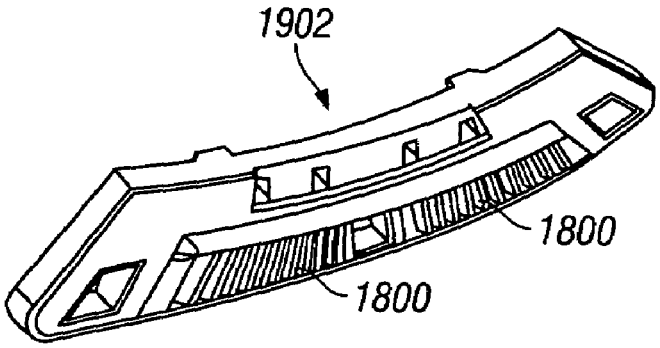
FIG. 22 is a schematic diagram of an isometric view of the opposite side of the articulated sidewall member shown in FIG. 21.

FIGS. 17 and 18 provide more detailed views of an exemplary articulated sidewall member 1702, shown apart from a lacrosse head. As shown articulated sidewall member 1702 includes coupling holes 1750 and threading holes 1752.

In a further embodiment of the present invention, FIGS. 19–22 show an exemplary articulated sidewall member 1902 having overlays 1800. These overlays 1800 provide enhanced ball control and ball dampening properties. The characteristics and exemplary materials of overlays 1800 are described in the related pending application Ser. No. 10/166,684, titled "Multi-Component Lacrosse Stick Head," filed Jun. 12, 2002, which is incorporated by reference herein in its entirety.

In one embodiment, articulated sidewall member 1902 is made of a rigid material on which overlays 1800 are affixed by, for example, insert molding, over molding, reaction injection molding, spray application, rotational molding, dual extrusion, casting, or an interference fit. Examples of suitable materials for articulated sidewall member 1902 include nylon, urethane, polycarbonate, polyethylene, polypropylene, polyketone, polybutylene terephalate, acetals (e.g., Delrin™ by DuPont), acrylonitrile-butadiene-styrene (ABS), acrylic, and acrylic-styrene-acrylonitrile (ASA). In one embodiment, articulated sidewall member 1902 includes recesses, cavities, depressions, or openings into which overlays 1800 are molded. In this manner, overlays 1800 can be formed on discrete portions of articulated sidewall member 1902, rather than, for example, fully encasing articulated sidewall member 1902.

Examples of suitable overlay materials include urethanes (TPU), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and flexible polyvinyl chloride (PVC). Specifically, for a nylon articulated sidewall member, examples of preferable overlay materials include Santoprene™, styrene-butadiene-styrene, styrene-ethylene-butylene-styrene, and alcryn. For a polycarbonate articulated sidewall member, an example of a preferable overlay material is alcryn (partially crosslinked halogenated polyolefin alloy). Finally, for a polypropylene articulated sidewall member, examples of preferable overlay materials include styrene-ethylene-butylene-styrene and thermoplastic vulcanizate (TPV).

Preferably, the overlay strongly bonds to the material of articulated sidewall member. Optionally, the bond between the overlay and the articulated sidewall member may be mechanical in the sense of an elastomer molded into or forced into plastic openings rather than just on the surface of the articulated sidewall member. For example, a pre-molded overlay could be inserted into a recess or opening (e.g., dovetail slots) in the articulated sidewall member and held in place by an interference fit.

In an alternative embodiment of the present invention, articulated sidewall member is 1902 is flexible. For example, articulated sidewall member could be made entirely of the overlay materials described above. In this manner, the articulated sidewall member can provide further pocket dampening by flexing and bending, in addition to swinging.

Figure 14:
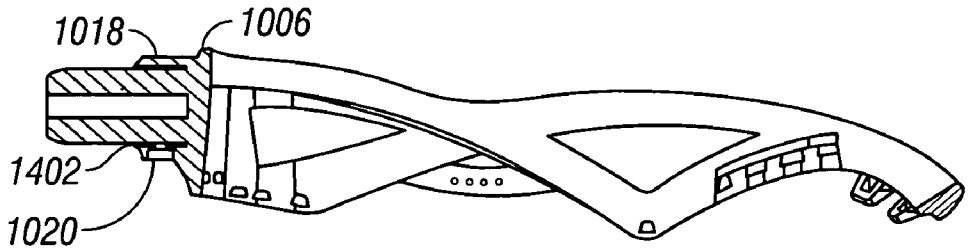
FIG. 14 is a schematic diagram of a cross-section of the lacrosse head of FIG. 13A along line A—A.
Figure 15:
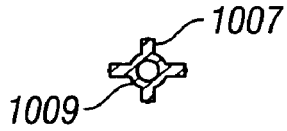
FIG. 15 is a schematic diagram of a cross-section of the lacrosse head of FIG. 13A along line B—B.
Figure 16:
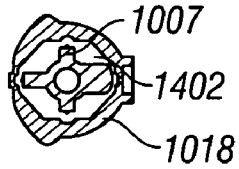
FIG. 16 is a schematic diagram of a cross-section of the lacrosse head of FIG. 13A along line C—C.

FIGS. 10C, 13A, 13C–13E, and 14–16 illustrate the exemplary collared male plug 1006, which includes a core 1009 having four compressible ribs 1007. The four ribs 1007 are located at the twelve, three, six, and nine o'clock positions of core 1009. Located around a portion of the length of core 1009 and ribs 1007 is a collar 1018 (see FIGS. 14 and 16). As best shown in FIGS. 14 and 16, collar 1018 creates a gap 1402 into which the wall of a shaft slides. FIG. 10C shows shaft 1014 in place, secured in gap 1402 between collar 1018 and ribs 1007. As shown best in FIG. 11, aligned openings 1020 in collar 1018 and shaft 1014 are adapted to receive a fastener that secures shaft 1014 to lacrosse head 1000.

According to a preferred embodiment of the present invention, collar 1018 is approximately 0.712 inches long and core 1009 is approximately 1.950 inches long. Core 1009 is preferably about 0.874 inches wide as measured across one set of opposing compressible ribs 1007 and about 1.062 inches wide as measured across the second set of opposing compressible ribs 1007. The short length of collar 1018 allows a player to hold shaft 1014 as close as possible to the center of gravity of head 1000 and a ball inside head 1000. The preferred dimensions and shapes of core 1009 and ribs 1007 help maximize the strength of the connection between lacrosse head 1000 and shaft 1014. The compressible ribs 1007 facilitate a tight friction fit with shaft 1014. In addition, compared to a solid plug fitted into the bore of shaft 1014, the compressible ribs 1007 and the shape of core 1009 help reduce the weight of core 1009 so as not to affect the center of gravity of the overall head 1000. For additional strength, the thickness of the stop member in throat area 1012 can also be increased to, for example, 0.235 inches.

Figure 24A:
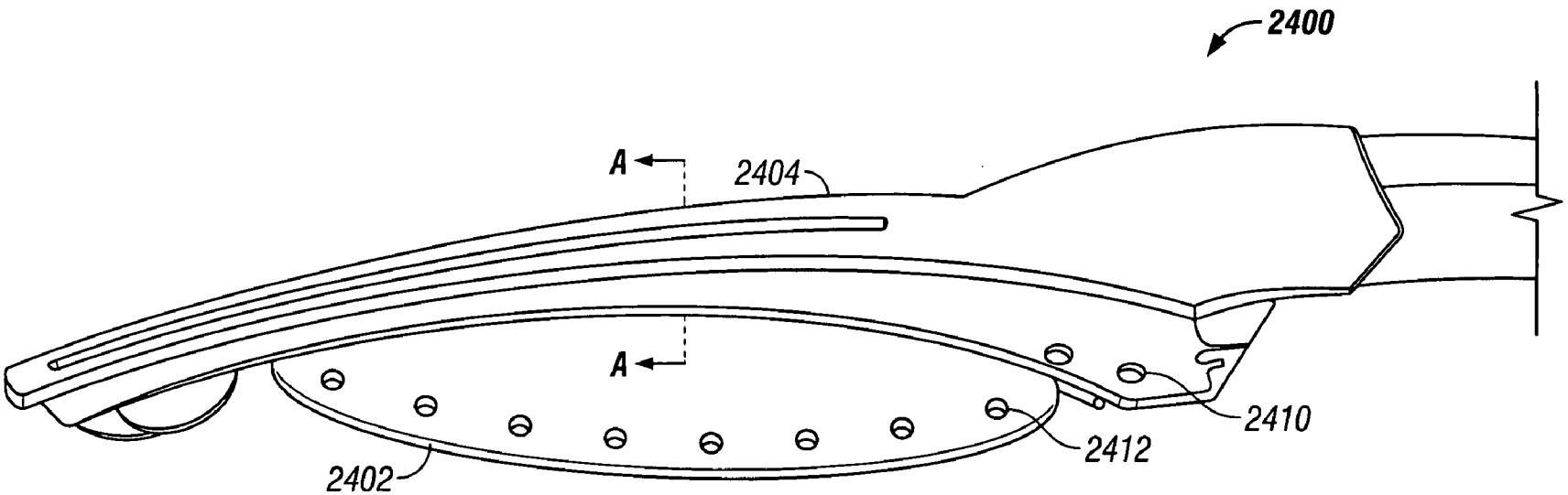
FIG. 24A is a schematic diagram of an exemplary lacrosse head having a hinged articulated sidewall member, according to an embodiment of the present invention.
Figure 24C:
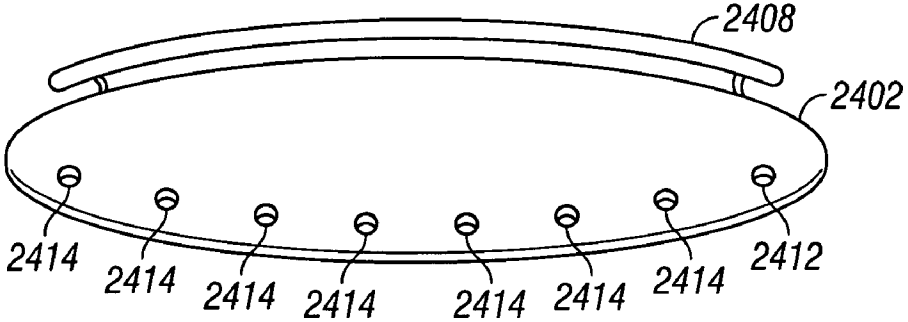
FIG. 24C is a schematic diagram illustrating the articulated sidewall member of FIG. 24A apart from the lacrosse head.
Figure 24B:
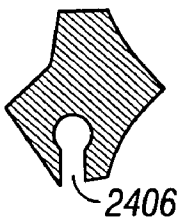
FIG. 24B is a schematic diagram of a cross-section of the lacrosse head of FIG. 24A along line A—A.

FIGS. 24A–27 illustrate further embodiments of the articulated member of the present invention. FIGS. 24A–24C illustrate an exemplary lacrosse head 2400 having a hinged articulated sidewall member 2402 moveably coupled to a sidewall member 2404 of head 2400. As shown in the cross-sectional view of FIG. 24B, sidewall member 2404 defines a slot 2406 for receiving and retaining a portion of articulated sidewall member 2402. In this example, as shown in FIG. 24C, articulated sidewall member 2402 includes a rail 2408 that slides into slot 2406. Retainer thread openings 2410 and 2412 are included in the head 2400 and the articulated sidewall member 2402, respectively, for receiving, for example, a lace or cord that prevents rail 2408 of articulated sidewall member 2402 from sliding out of slot 2406. Articulated sidewall member 2402 also includes pocket thread openings 2414 for attaching a pocket to head 2400.

Figure 25:
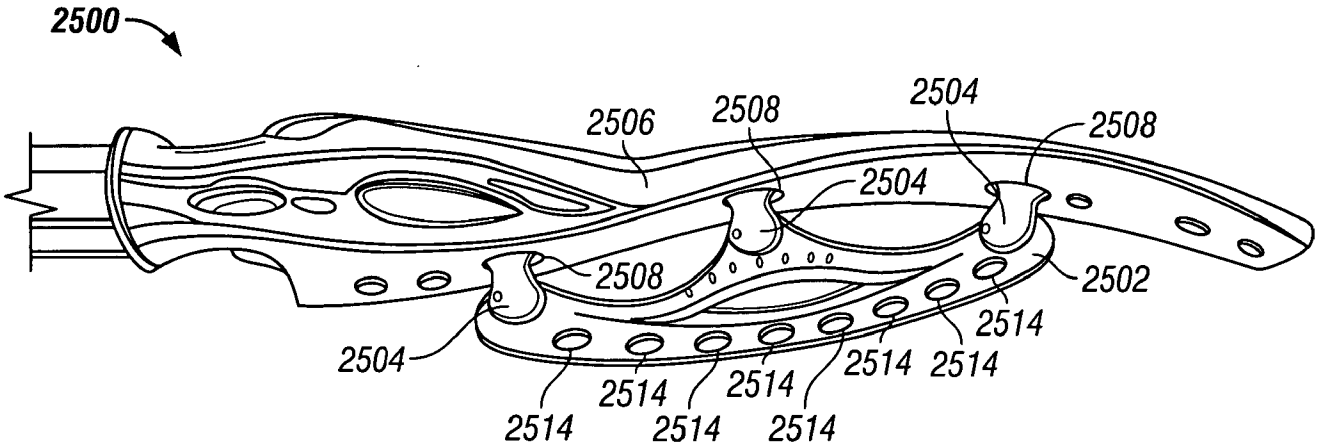
FIG. 25 is a schematic diagram of an exemplary lacrosse head having an articulated sidewall member attached by straps, according to an embodiment of the present invention.

FIG. 25 illustrates an exemplary lacrosse head 2500 having an articulated sidewall member 2502 attached by straps 2504, according to an embodiment of the present invention. The sidewall member 2506 of head 2500 includes strap openings 2508 that receive the straps 2504 of articulated sidewall member 2502. In this example, straps 2504 loop through strap openings 2508, with their ends attached to articulated sidewall member 2502. Straps 2504 are fastened to articulated sidewall member 2502 by, for example, rivets or by molding the ends of the straps to articulated sidewall member 2502. Optionally, straps 2504 are integrally formed with articulated sidewall member 2502 such that both straps 2504 and articulated sidewall member 2502 are flexible (e.g., formed from the overlay materials described above). Articulated sidewall member 2502 also includes pocket thread openings 2514 for attaching a pocket to head 2500.

Figure 26:
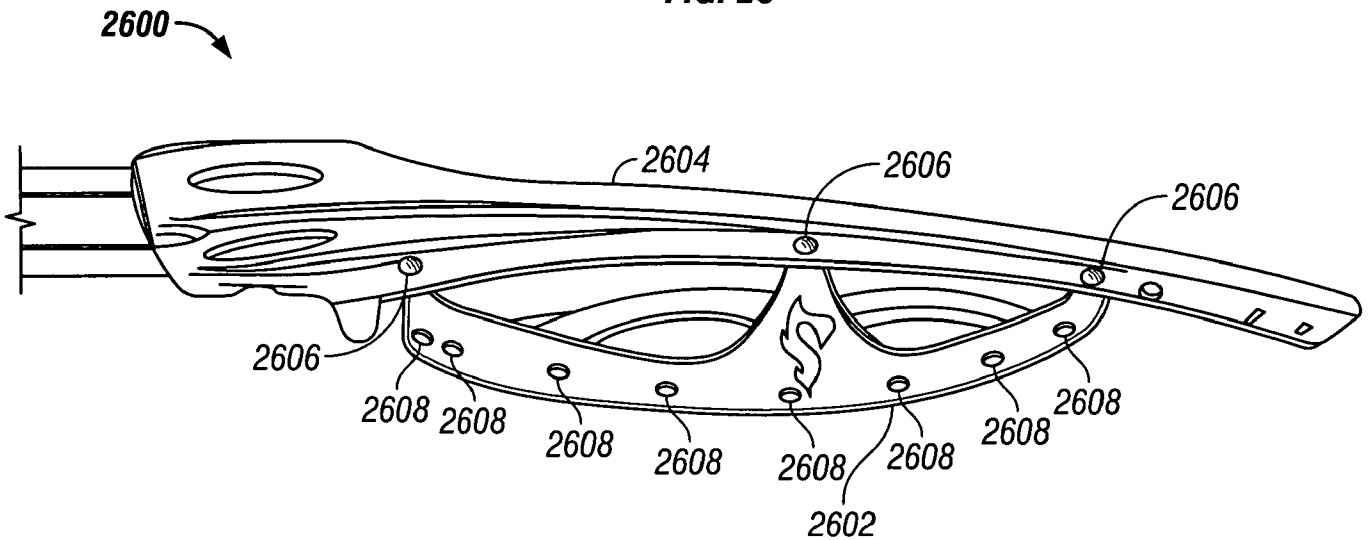
FIG. 26 is a schematic diagram of an exemplary lacrosse head having a flexible articulated sidewall member, according to an embodiment of the present invention.

FIG. 26 illustrates an exemplary lacrosse head 2600 having a flexible articulated sidewall member 2602, according to an embodiment of the present invention. For example, articulated sidewall member 2602 could be made entirely of the overlay materials described above. As shown, fasteners 2606 (e.g., rivets) attach articulated sidewall member 2602 to the sidewall member 2604 of head 2600. Articulated sidewall member 2602 includes pocket thread openings 2608 for attaching a pocket to head 2600. In this embodiment, the flexibility of articulated sidewall member 2602 adds a further aspect of pocket dampening, in addition to the swing of member 2602. This flexibility also enables articulated sidewall member 2602 to be directly affixed to head 2600.

The embodiments described above illustrate an articulated member disposed in the sidewall of a lacrosse head. Alternatively, however, the articulated member can be disposed in other locations of a lacrosse head to provide benefits similar to those described above. For example, the articulated member can be disposed in the scoop or in the stop member of a lacrosse head. In these locations, the articulated member can also included thread openings for receiving a pocket strung to the head. In addition, the articulated member could be moveably coupled to swing as an extension of the lacrosse head frame (e.g., as a flap on the edge of the frame) or as a moveable interior portion of the frame (e.g., as a moveable cutout within the rigid frame), as described above.

Figure 27:
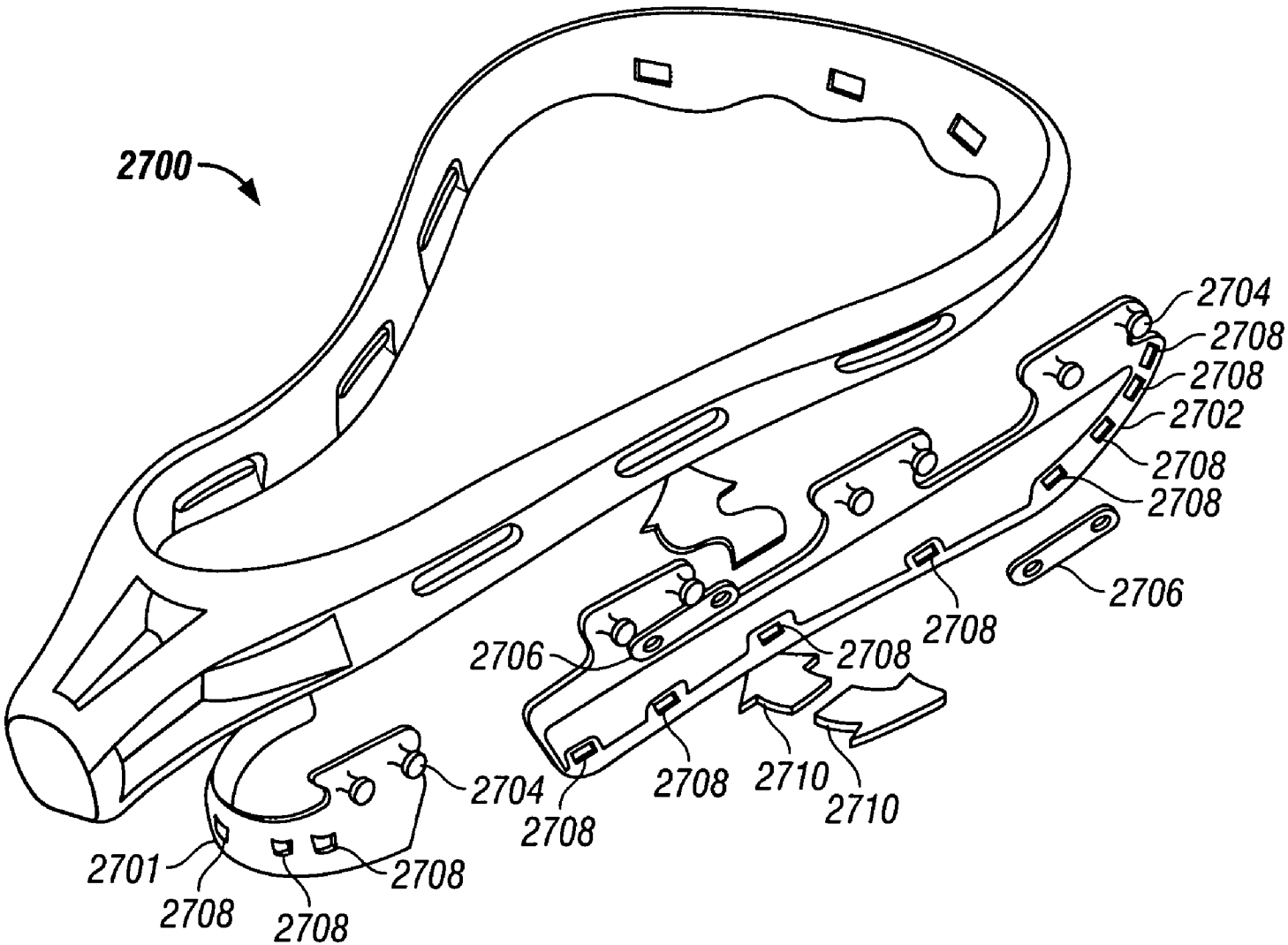
FIG. 27 is a schematic diagram of an exemplary lacrosse head having an articulated sidewall member and an articulated stop member, according to an embodiment of the present invention.

FIG. 27 illustrates this alternative embodiment, showing a lacrosse head 2700 having an articulated stop member 2701, in addition to an articulated sidewall member 2702. In this example, members 2701 and 2702 are made of a flexible material (e.g., the overlay materials described above) and are attached to head 2700 using fasteners 2704 in conjunction with clamp plates 2706. The flexibility enables members 2701 and 2702 to swing as represented by arrows 2710. Articulated stop member 2701 and articulated sidewall member 2702 include pocket thread openings 2708 for attaching a pocket to head 2700.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What is claimed is:

1. A lacrosse head comprising:
a stop member;
a first sidewall connected to the stop member;
a second sidewall connected to the stop member opposite the first sidewall; and
a scoop connected to the first sidewall and the second sidewall opposite the stop member,
wherein the stop member comprises
a first member integrally connected to the first sidewall and the second sidewall, and
a second member moveably coupled to the first member and defining an open space with respect to the first member, wherein the second member has a thread opening.

2. The lacrosse head of claim 1, wherein the thread opening is configured to receive a thread of a pocket.

3. The lacrosse head of claim 1, further comprising a pocket attached to the thread opening.

4. The lacrosse head of claim 1, wherein the second member is moveably coupled to the first member by one of a cord, a hinge, and an elastomeric strap molded onto the first member and the second member.

5. The lacrosse head of claim 1, wherein the second member is made of one of urethane, partially crosslinked halogenated polyolefin alloy, styrene-butadiene-styrene, styrene-ethylene-butylene styrene, thermoplastic olefinic, thermoplastic vulcanizate, ethylene-propylene rubber, and flexible polyvinyl chloride.

6. The lacrosse head of claim 1, wherein the lacrosse head has a front face through which a ball is received and a back face at which a pocket is disposed, and wherein the second member is disposed at the back face.

7. The lacrosse head of claim 1, further comprising a shaft attached to the frame.

8. The lacrosse head of claim 1, wherein the second member is an interior portion of the stop member.

9. The lacrosse head of claim 1, wherein the scoop, the first sidewall, the second sidewall, and the stop member comprise a frame, wherein the frame defines an interior area when viewed from a face view of the frame, and wherein the lacrosse head further comprises a stiffening member attached to the scoop and the first sidewall, wherein the stiffening member spans a portion of the interior area.

10. The lacrosse head of claim 9, wherein the stiffening member is attached to a first point on the scoop and a second point on the first sidewall, and wherein the stiffening member is continuously attached to the frame from the first point to the second point.

11. The lacrosse head of claim 9, wherein the stiffening member defines a thread opening to receive a thread of a pocket strung to the lacrosse head.

12. The lacrosse head of claim 9, wherein the stiffening member is a triangular gusset that has at least one opening adapted to receive a thread of a pocket strung to the lacrosse head.

13. The lacrosse head of claim 1, further comprising a connector adapted to join the lacrosse head to a hollow shaft having a bore and a wall, the connector comprising:

a core plug adapted to be inserted into the bore of the shaft, wherein the core plug has compressible ribs, and a collar surrounding the core plug such that a gap exists between the core plug and the collar, wherein the gap is adapted to receive the wall of the shaft, and wherein the compressible ribs are compressed by the wall of the shaft when the shaft is fully seated in the connector.

14. The lacrosse head of claim 13, wherein the core plug protrudes beyond the collar.

15. The lacrosse head of claim 1, wherein the second member includes a recess into which an overlay is molded.

16. The lacrosse head of claim 1, wherein the second member is made of one of nylon, urethane, polycarbonate, polyethylene, polypropylene, polyketone, polybutylene terephalate, acetal, acrylonitrile-butadiene-styrene, acrylic, and acrylic-styrene-acrylonitrile.

17. The lacrosse head of claim 1, wherein the second member has a rail, and wherein the first member defines a slot that receives the rail to moveably couple the second member to the first member.

18. The lacrosse head of claim 17, wherein the first member has a first retainer thread opening, wherein the second member has a second retainer thread opening, and wherein the head further comprises a retainer thread strung through the first retainer thread opening and the second retainer thread opening.

19. The lacrosse head of claim 1, wherein the first member has first member coupling holes, wherein the second member has second member coupling holes, and wherein the lacrosse head further comprises a cord strung between the first member coupling holes and the second member coupling holes.

20. A lacrosse head comprising:

a frame having an integral stop member portion, an integral first sidewall portion adjacent to the stop member portion, an integral second sidewall portion adjacent to the stop member portion and opposite the first sidewall portion, and an integral scoop portion adjacent to the first sidewall portion and the second sidewall portion and opposite the stop member portion; and a member moveably coupled to one of the stop member portion, the first sidewall portion, the second sidewall portion, and the scoop portion, wherein the member defines an open space with respect to the one of the stop member portion, the first sidewall portion, the second sidewall portion, and the scoop portion, and wherein the second member defines a thread opening.

21. The lacrosse head of claim 20, further comprising a pocket attached to the lacrosse head.

22. The lacrosse head of claim 20, further comprising a shaft attached to the lacrosse head.

* * * * *